US005233572A

United States Patent [19]

McCarty, Jr.

[11] Patent Number: 5,233,572

[45] Date of Patent: Aug. 3, 1993

[54] MEANS FOR GENERATING A SUCCESSION OF PROMPTS REQUIRING A CORRESPONDING SUCCESSION OF USER INPUTS WHERE EACH PROMPT IS PRESENTED ON A RANDOM INTERVAL SCHEDULE OF REINFORCEMENT

[75] Inventor: Kenneth D. McCarty, Jr., 5050 Garford #89, Long Beach, Calif. 90815

[73] Assignee: Kenneth D. McCarty, Jr., Long Beach, Calif.

[21] Appl. No.: 596,961

[22] Filed: Oct. 15, 1990

[51] Int. Cl.[5] ..... G04F 8/00; G04B 19/06

[52] U.S. Cl. ..... 368/107; 368/230

[58] Field of Search ..... 368/10.72–10.74, 368/230, 250, 251; 340/407, 566

[56] References Cited

U.S. PATENT DOCUMENTS

| | | | |
|---|---|---|---|
| 4,297,677 | 10/1981 | Lewis et al. | 340/148 |
| 4,361,408 | 11/1982 | Wirtschaftar | 368/10 |
| 4,576,484 | 3/1986 | Grossmeyer | 368/245 |
| 4,589,780 | 5/1986 | Takebe | 368/245 |
| 4,632,570 | 12/1986 | Kelsey | 368/107 |
| 4,637,732 | 1/1987 | Jones | 368/109 |
| 4,728,934 | 3/1988 | Pfander et al. | 340/407 |
| 4,731,603 | 3/1988 | McRae et al. | 340/407 |
| 4,853,854 | 8/1989 | Behar et al. | 368/10 |

FOREIGN PATENT DOCUMENTS

| | | |
|---|---|---|
| 3106656 | 11/1985 | Fed. Rep. of Germany . |
| 618827 | 2/1983 | Switzerland . |

*Primary Examiner*—Vit W. Miska

[57] ABSTRACT

A device whereby the wearer receives a succession of prompts on a random interval schedule of reinforcement when activated by a corresponding succession of user inputs comprising: push of input push button, switch to determine if input is valid or invalid, means to activate random number generator, means to activate decrement, switch to determine completion or non-completion of decrement, output of one pulse, push of input push button, switch to determine if input is valid or invalid, step timer, switch to determine if invalid input push button occurred within ten seconds of output of one pulse, a push of input push button, switch to determine if input is valid or invalid, step timer, switch to determine if invalid input push button occurred within ten seconds of push of input push button, means to activate random number generator, means to activate decrement, switch to determine completion or non-completion of decrement, and output of two pulses.

1 Claim, 3 Drawing Sheets

MEANS FOR GENERATING A SUCCESSION OF PROMPTS REQUIRING A CORRESPONDING SUCCESSION OF USER INPUTS WHERE EACH PROMPT IS PRESENTED ON A RANDOM INTERVAL SCHEDULE OF REINFORCEMENT

BACKGROUND

1. Field of Invention

This invention relates generally to wearable signalling devices and more particularly to a means for generating a succession of prompts requiring a corresponding succession of user inputs where each prompt is presented on a random interval schedule of reinforcement.

2. Description of Prior Art

Prior art utilizes invariate user input to activate program of timed signals. U.S. Pat. No. 4,576,484 provides the user with a plurality of patterned signals, whose urgency is a function of elapsed time. U.S. Pat. No. 4,361,408 includes a signalling apparatus connected to a timer for use in scheduling medications. While outputs from such devices may vary, user inputs do not. The proposed requires the correspondence of a succession of user inputs with a succession of device outputs within each program. Users must not only activate each program, but must continue to interact appropriately within each program to receive the corresponding prompts.

Prior art outputs occur in patterns based on the passage of fixed intervals of time. U.S. Pat. No. 4,637,732 signals relevant elapsed time intervals in athletic contests for use by officials and others. Foreign patents DE 3106-656 (N. Reimann) and CH 618827 (K. Weber) describe devices that emit tactile signals of elapsed time for the blind. Signals on such fixed interval schedules of reinforcement would produce lower response rates than would signals on random schedules for the applications envisioned. Behavioral psychology literature provides extensive documentation on the significantly greater rate of response with variable (random) interval schedules of reinforcement than with fixed ones.

Certain developments in psychological therapy, self-help psychology, and other fields suggest that individuals can intentionally train themselves to supersede their own thought and associated behavior with a carefully reinforced new one. Proponents contend that the efficacy of in fixing such that is significantly enhanced by repetitive, incisive prompting. This device will be useful to proponents and their practitioners in their efforts, as well as to professionals concerned with gathering systematic data relevant to theoretical, research, or applied knowledge of human behavior.

OBJECTS AND ADVANTAGES

Accordingly, the objects and advantages of my invention are that it: a) generates a succession of prompts when activated by a corresponding succession of user inputs, in contrast to prior art which utilizes invariate user input and b) provides signals on a random interval schedule of reinforcement, in contrast to prior art which provides signals at fixed intervals.

Further objects and advantages of my invention become apparent from a consideration of the drawings and ensueing descriptions of them.

DRAWING FIGURES

REFERENCE NUMERALS IN DRAWINGS

Figure 1:
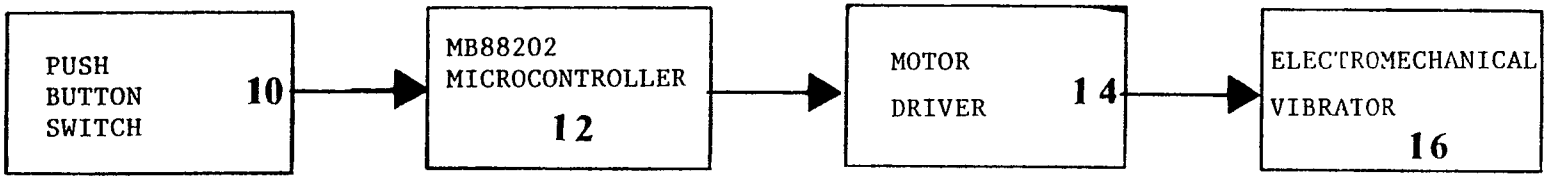
FIG. 1 shows a MB88202 microcontroller circuit arrangement that produces a succession of prompts requiring a corresponding succession of user inputs, where each prompt is presented on a random interval schedule of reinforcement.

10: push button switch
12: MB88202 microcontroller
14: motor driver
16: electromechanical vibrator
18: start
20: input push button
22: button valid
24: random number generator
26: decrement
28: N=0
30: output of one pulse
32: input push button
34: button valid
36: step timer
38: timer (<10 seconds)
40: input push button
42: button valid
44: step timer
46: timer (<10 seconds)
48: random number generator
50: decrement
52: N=0
54: output of two pulses
56: power supply
58: MB88202 microcontroller circuit
60: input push button
62: motor
64: drive shaft
66: semicircular lobe

DESCRIPTION AND OPERATION OF FIGS. 1, 2, 3, AND 4

FIG. 1 is a MB88202 microcontroller circuit arrangement that produces the proper signal for a succession of prompts requiring a corresponding succession of user inputs, where each prompt is presented on a random interval schedule of reinforcement.

A push button switch 10 produces a signal that initiates program sequence in MB88202 microcontroller 12 whose digital trigger pulse output routes to motor driver 14. Motor driver 14 produces signal amplification and routes to electromechanical vibrator 16.

Figure 2:
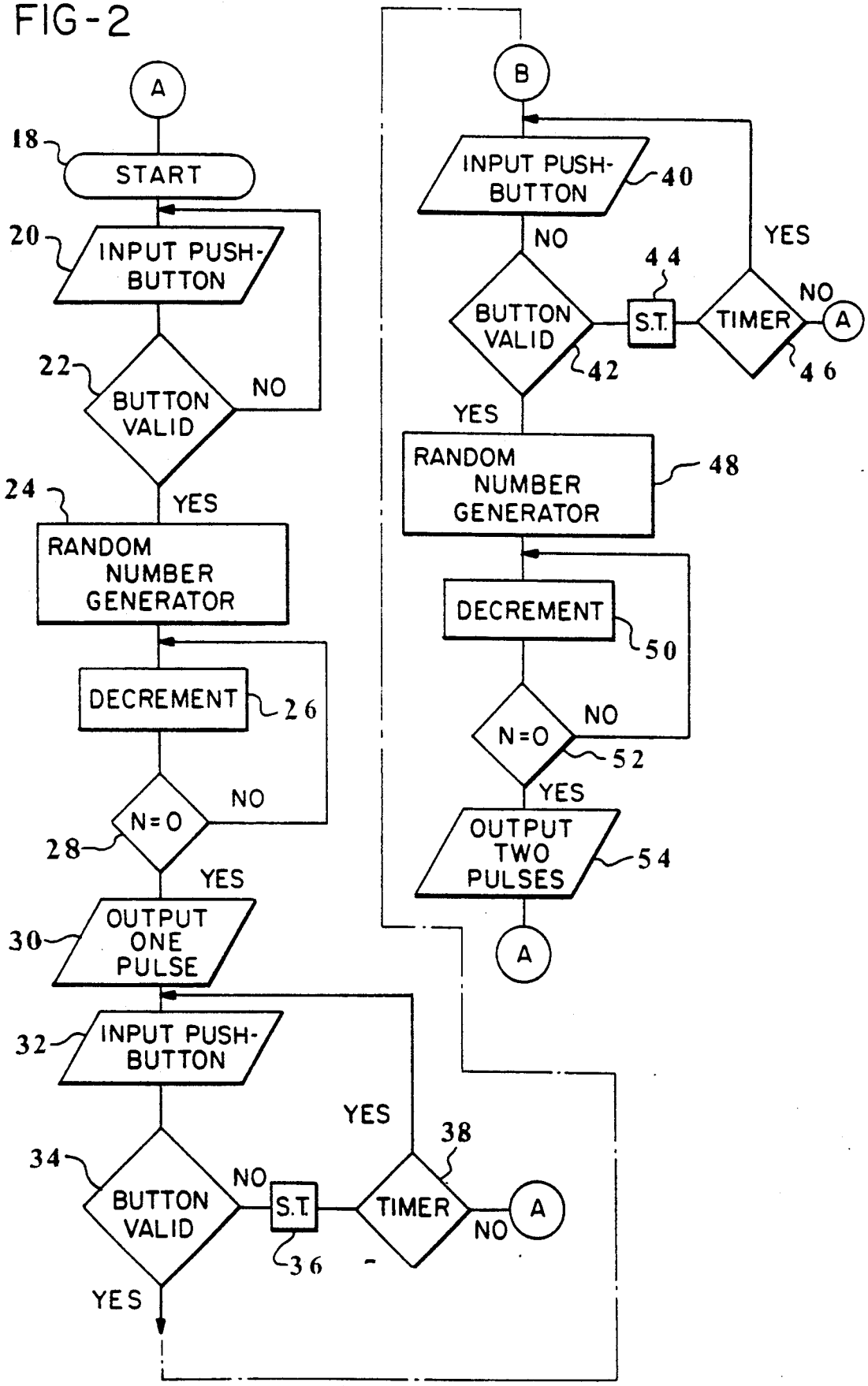
FIG. 2 shows an encoded program within a MB88202 microcontroller that produces a succession of prompts requiring a corresponding succession of user inputs, where each prompt is presented on a random interval schedule of reinforcement.

FIG. 2 shows a flow chart of the program encoded within MB88202 microcontroller as per FIG. 1. After start 18, one push of input push button 20, if valid at 22, activates random number generator 24, which begins decrement 26. Through switch 28 non-completion of decrement recycles to 26 for continuation of decrement. Completion of decrement through switch 28 results in output of one pulse at 30. One push of input push button 32, if invalid at 34, recycles to 32 through step timer 36 and timer (<10 seconds) 38. When pulse from 32 is valid at 34, input push button 40 can accept a second input. If invalid at 42 it recycles to 40 through step timer 44 and timer (<10 seconds) 46. If valid at 42 pulse activates random number generator 48 and begins decrement 50. Through switch 52 non-completion of decrement recycles to 50 for continuation of decrement. Completion of decrement through switch 52 results in output of two pulses 54 and recycles to start.

Figure 3:
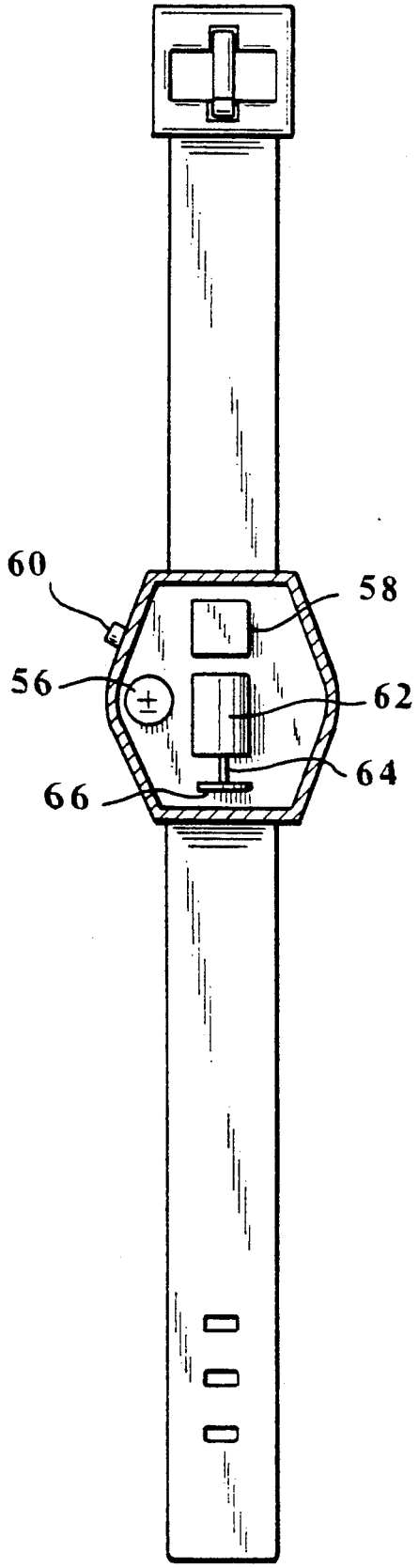
FIG. 3 shows a preferred embodiment of a MB88202 microcontroller circuit as per FIGS. 1 and 2 with the electromechanical vibrator embodied as a motor, drive shaft, and semicircular lobe assembly, will within a wrist watch enclosure.

FIG. 3 shows a preferred embodidment consisting of a wrist watch enclosures for a power supply 56 within a MB88202 microcontroller circuit arrangement 58 (as per FIGS. 1 and 2) activated by input push button 60 which induces motor 62 to turn drive shaft 64 and attached semicircular lobe 66 whose uneven shape and turning motion results in a vibration that serves as a prompt to the device wearer.

Figure 4:
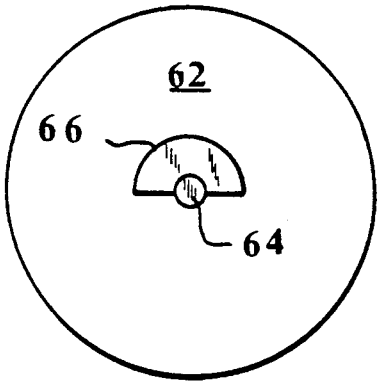
FIG. 4 shows an end view of the motor, drive shaft, and semicircular lobe assembly of FIG. 3.

FIG. 4 shows and end view of the electromechanical vibrator for the preferred embodiment in FIG. 3. As per FIGS. 1 and 2 a MB88202 microcontroller circuit arrangement provides the appropriate pulse to drive motor 62, attached to drive shaft 64, and attached semicircular lobe 66, whose uneven shape and turning motion results in vibration which serves as a prompt to the device wearer.

SCOPE OF THE INVENTION

Thus the reader will see that the means for generating a succession of prompts requiring a corresponding succession of user inputs, where each prompt is presented on a random interval schedule of reinforcement is distinctly different from both invariate input devices and from devices that provide signals after fixed intervals. Such prompting and infixing of thought, according to certain proponents and practitioners, significantly impacts learning. Once available the proposed device will focus and refine their efforts, as well as give other interested parties an opportunity to gather and analyze orderly and systematic data on any claims or ramifications of this approach to enhancing human thought and behavior.

While my above description contains many specificities, these should not be construed as limitations on the scope of the invention, but rather as an exemplification of a preferred embodiment thereof. For example, the size of the device would vary with application. A piezoelectric tactile transducer would function well in place of the motor, shaft, and lobe assembly described herein. External physical variations would accompany underwater or space applications. Use in animal training may involve these or other modifications. Accordingly, the scope of the invention should be determined not by the embodiment illustrated, but by the appended claims and legal equivalents.

I claim:

1. A method for generating a behavior-based prompt utilizing a microcontroller containing a random number generating means, a decrementing means, a timing means which times out when set, and wherein said microcontroller is encoded with an electronically encoded program, a manually operable actuator means coupled as an input to said microcontroller, and a tactile transducer coupled to an output from said microcontroller for generating and transmitting tactile stimulus signals, the steps comprising:

electrically monitoring operation of said manually operable actuator means, generating a first random number in said random number generating means responsive to a single manual operation of said actuator means, repetitively decrementing said random number generating means by units until said random number generating means is fully decremented, generating a single output pulse to said tactile transducer and setting said timing means to a predetermined time interval when said random number generator is fully decremented, generating a second random number in said random number generating means responsive to operation of said manually operable actuator within said predetermined time interval, repetitively decrementing said random number generating means by units until said random number generating means is fully decremented, generating a pair of successive output pulses to said tactile transducer when said random number generating means is fully decremented to thereby generate a pair of successive tactile output signals.

* * * * *